US005199708A

United States Patent [19]

Lucas

[11] Patent Number: 5,199,708

[45] Date of Patent: Apr. 6, 1993

[54] LAWN ROLLER GAME

[76] Inventor: Raymond Lucas, 5960 Parkman Rd., NW., Warren, Ohio 44481

[21] Appl. No.: 898,526

[22] Filed: Jun. 15, 1992

[51] Int. Cl.[5] ..... A63F 3/00; A63B 67/06

[52] U.S. Cl. ..... 273/126 R; 273/108; 273/128 R; 273/128 A; 446/450; 446/236

[58] Field of Search ..... 273/108, 118 R, 126 R, 273/126 A, 128 R, 128 CS, 128 A, 424, 425, 427; 446/450, 411, 236

[56] References Cited

U.S. PATENT DOCUMENTS

| | | | |
|---|---|---|---|
| 445,016 | 1/1891 | Greene . | |
| 1,119,673 | 12/1914 | Bellamy | 273/126 R |
| 1,551,981 | 9/1925 | Dette . | |
| 1,906,025 | 4/1933 | Steenkiste | 273/126 R |
| 1,922,578 | 8/1933 | Fernandez | 273/126 R |
| 2,269,941 | 1/1942 | Jones | 273/126 R |
| 3,237,947 | 3/1966 | Masters . | |
| 3,575,416 | 4/1971 | Cooper | 273/126 R |
| 4,293,132 | 10/1981 | Starr . | |

*Primary Examiner*—V. Millin
*Assistant Examiner*—Raleigh W. Chiu
*Attorney, Agent, or Firm*—Harpman & Harpman

[57] ABSTRACT

A lawn roller game apparatus and a method of playing the game. The invention comprises a plurality of ring elements having contoured inner surface and a handle port. Pairs of spaced playing posts are positioned at either end of the generally flat playing surface. The ring elements are rolled on the playing surface towards the playing posts scoring points based on closeness of the rings to playing posts.

3 Claims, 2 Drawing Sheets

LAWN ROLLER GAME

BACKGROUND OF THE INVENTION

1. Technical Field:

This invention relates to lawn games and the like in which playing pieces are rolled or tossed at a pre-determined target to generate a score based on positioning factors determined by closeness to the post or contact with the target post such as in the time honored game of horse shoes.

2. Description of Prior Art:

Prior Art devices of these types rely on a variety of different playing elements and targets for same, see for example U.S. Pat. Nos. 4,293,132, 3,237,947, 1,551,981 and 445,016.

In U.S. Pat. No. 445,016 a game device is shown having a target area with designated point sub-areas. Rings are spun on the respective edges on the target surface. Where the ring falls indicates the point value which is awarded to the player.

U.S. Pat. No. 1,551,981 a game is disclosed wherein a playing board and surface is used to define a target area. A plurality of horse shoe shaped closed loops are positioned at one end. A player's ring is rolled on the board towards the loop engaging the loops via a loop lip which allows access to the loop. Scoring is determined based on the engagement of the rings within the loops.

U.S. Pat. No. 3,237,947 has a rollable split ring game device. The game board or playing area has scoring values marked at one end thereof. The split rings have an adjustable weight movably positioned within their perimeters on parallel support rods. The weight can be moved along the rods as desired to change the balance of the ring as it rolls towards the target area.

Finally, in U.S. Pat. No. 4,293,132 a skid wheel game and apparatus is shown wherein an elongated segmented playing surface is laid out. A wheel is then tossed onto the surface with a reverse rotation thereto. The ring comes to rest on the partition zone is awarded the representative points associated therewith.

SUMMARY OF THE INVENTION

A lawn roller game comprising a playing area defined by placement of scoring posts at oppositely disposed ends thereof. The game is played using a number of identical ring elements that are rolled towards the opposing scoring posts from adjacent the opposite posts. The resting position of the rolled ring near or against the posts determines the point value and the player's eventual score. A grip opening within the playing element allows for selective registration of the player's fingers within for rolling the ring towards the opposing scoring posts.

DESCRIPTION OF THE PREFERRED EMBODIMENT

Figure 1:
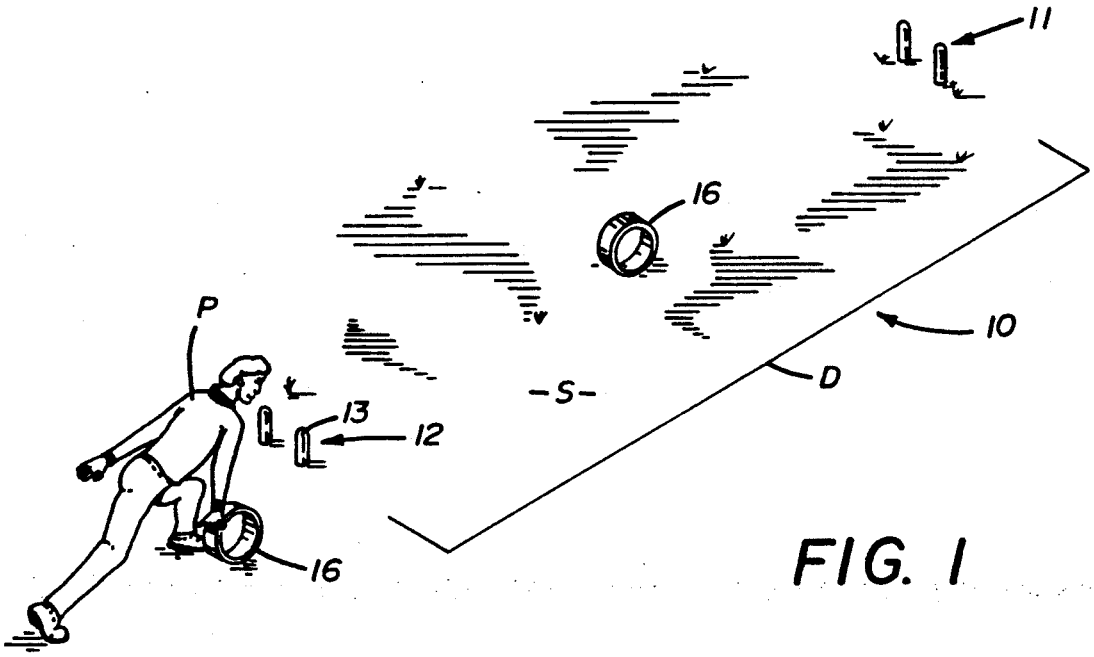
FIG. 1 is a perspective view of the preferred form of the invention and a demonstration of how the game is played on a lawn surface.

Referring to FIG. 1 of the drawings, a lawn roller game 10 can be seen in play by a player P. The lawn roller game 10 comprises a playing surface S having pairs of game target posts 11 and 12 positioned at respective ends of the playing surface S. Each of the pairs of the target posts 11 and 12 is comprised of an elongated post element 13 having a pointed ground engaging end 14 and a rounded oppositely disposed playing end 15.

Figure 4:
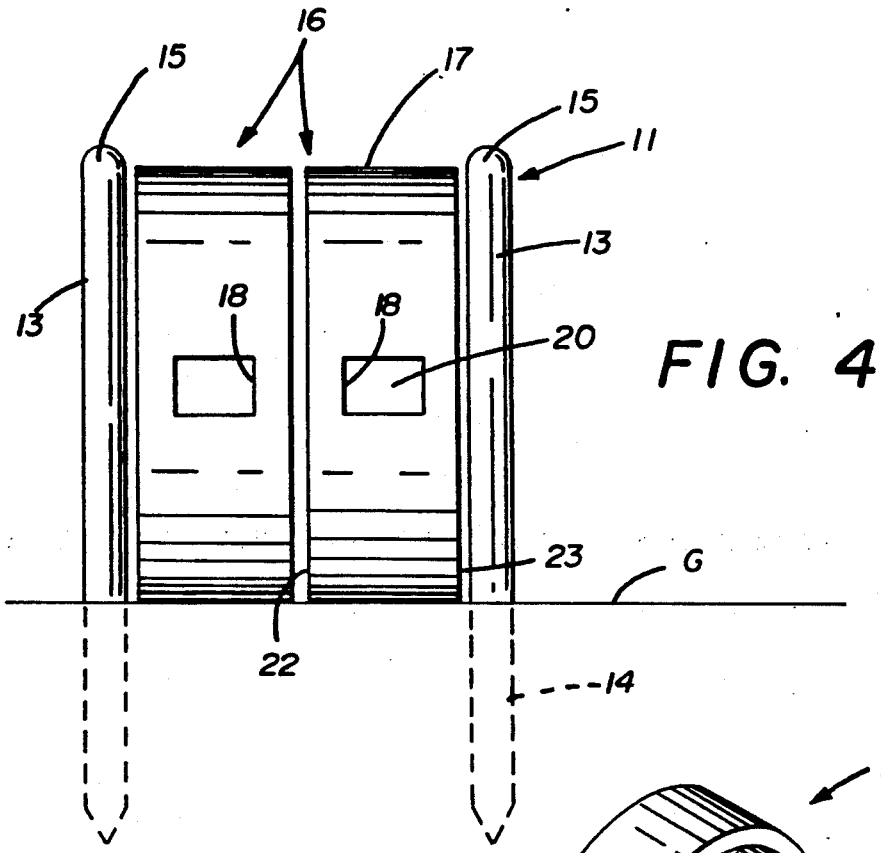
FIG. 4 is an enlarged side plan view of game target posts and a pair of playing rings therebetween.
Figure 5:
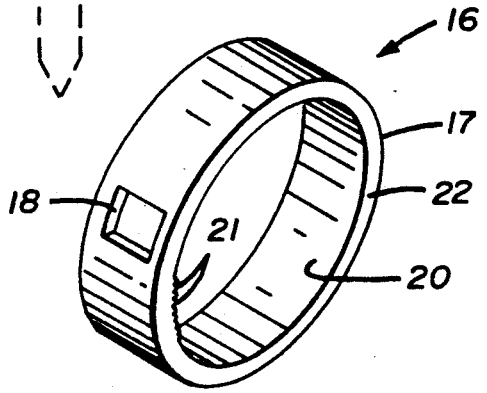
FIG. 5 is a perspective view of a playing ring.
Figure 6:
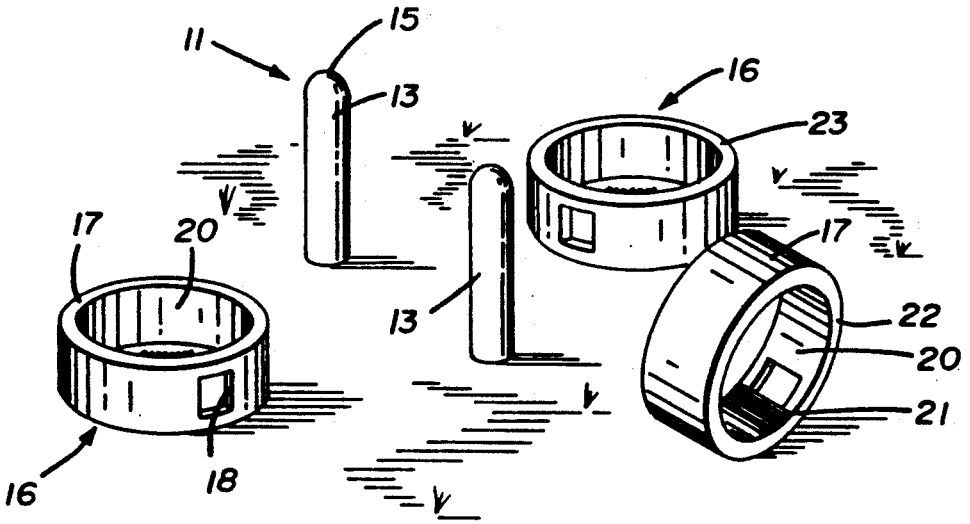
FIG. 6 is a perspective view of a number of playing rings positioned adjacent to a pair of game target posts as would appear during use.

In use, each of the posts elements 13 are driven into the ground G in spaced parallel relation to one another forming the pairs of game target posts 11 and 12 as seen in FIGS. 1,4, and 6 of the drawings. The game target posts pairs 11 and 12 thus positioned on the playing surface S define a pre-selected distance therebetween in accordance with the requirements of play.

Figure 2:
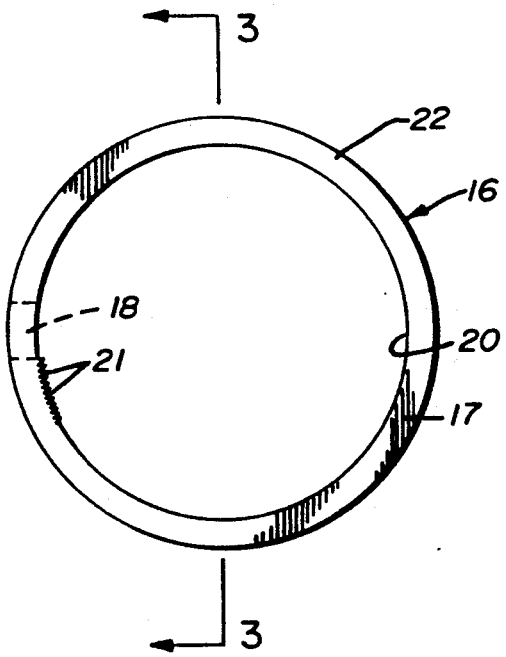
FIG. 2 is an enlarged side plan view of a playing piece.
Figure 3:
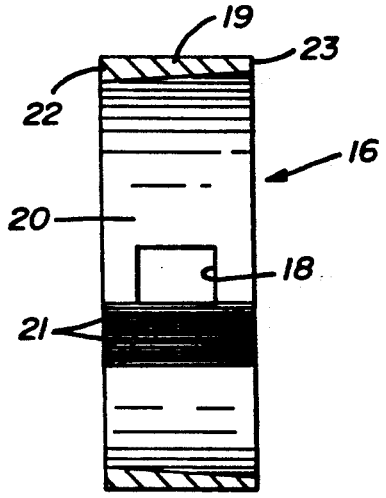
FIG. 3 is a cross-section on lines 3—3 of FIG. 2.

Referring now to FIGS. 2,3 and 4 of the drawings, a playing ring 16 can be seen comprising a main body member 17 with a finger grip opening at 18. Each of the playing rings 16 has a tapered transverse cross-section at 19 that defines a tapered continuous inner wall surface 20 as best seen in FIG. 3 of the drawings. The finger grip opening at 18 is positioned midway within said continuous inner wall surface 20 and is of a generally rectangular configuration with its lengthwise dimension aligned transversely with the inner wall surface 20. A plurality of parallel raised ridges 21 extend across the inner wall surface 20 adjacent to and extending a short distance from said finger grip opening at 18.

In use, the player P can grip the playing ring 16 if desired by inserting their fingers or portions thereof (not shown) through the opening at 18 tactually engaging the raised ridges 21 for purchase. The playing ring 16 have a different edge dimensions at 22 and 23 respectively due to the tapered inner wall surface 20 as hereinbefore described.

Each of the playing rings 16 are of an equal height and width to one another, that is proportionally defined as a height equal to 2.8 times the respective width. This proportion of height to width is important to the play of the game since the playing rings 16 must have a stable roll characteristics as they are propelled over the playing surface S by the player P. Each of the posts 13 of the respective pairs of game target posts 11 and 12 are spaced in relation to one another a distance equal to twice the respective known width of said playing ring 16 as best illustrated in FIG. 4 of the drawings. This spacing of the target posts 13 of the game target posts pairs 11 and 12 is critical to the play action of the game. The target posts pairs 11 and 12 define the playing area therebetween and help determine the difficulty of the playing rings 16 placement by the player P.

Different scoring points and combinations of same are possible by the varied end placement of the playing rings 16 relative to the game target posts pairs 11 and 12.

For example, one point is awarded the player P if the playing ring 16 is closest either of the posts 13 of said target post pair 11 as seen in FIG. 6 of the drawings.

Two points are awarded the player P for the playing ring 16 closest the target posts pair 11 and is standing on its outer curved surface 23.

Five points is awarded the player P if the playing ring 16 is between said post 13 of the game post pair 11 and six points is awarded the player if the playing ring 16 is between the target posts 13 of the target post pair 11 and closest to either of the target posts 13.

Seven points is awarded the player P if the playing ring 16 is closest to the target posts pair 11 and standing as hereinbefore described.

The playing rings 16 are also color coded in respective players groups (not shown) to define a players P's respective playing ring 16.

The player P accumulates score points by the various positions and attitude of the ring in relation to the game target posts pair used with the object of the game to receive a maximum of 30 points to be declared the winner.

When playing the game, the player P must stand at the respective end of the playing surface S and must be behind or beside the respective pair of target posts at the respective end of the playing surface.

The present invention is not intended to be restricted to any particular form or arrangement or any specific embodiment disclosed therein or any specific use since the same may be modified in various particulars or relation without departing from the spirit or scope of the claimed invention here and above as shown and described of which the methods shown are intended only for illustration and for disclosure of an operative embodiment and not to show all of the various forms of modification in which the invention might be embodied.

Having thus illustrated and described my invention, it will be obvious to those skilled in the art that various changes and modifications may be made therein without departing from the spirit of the invention.

Therefore, I claim:

1. A lawn roller game comprising a longitudinally extending playing surface defined between at least two pairs of spaced target posts, each of said pairs of target posts are positioned in spaced parallel relation to one another, said game including playing rings, having a central axis and a periphery, said rings being adapted to be projected linearly along the playing surface towards one of said pairs of said target posts, each of said playing rings of a known height equal to at least two times its known width, having an continuous inner wall surface, each pair of said target posts comprised of spaced parallel post elements, said post elements are spaced in relation to one another a distance equal to twice the transverse width of said playing ring, a finger opening defined in said continuous inner wall surface and extending outwardly therethrough of each of said playing rings, and means for gripping said rings through said finger openings.

2. The lawn roller game of claim 1 wherein said playing rings have a plurality of parallel raised ridges extending from said finger opening on said continuous inner wall surface of said ring.

3. The method of playing a lawn roller game which comprises;

selecting a longitudinally disposed playing surface define between two pairs of spaced target posts therebetween, each of said pairs of target posts are positioned in spaced parallel relation to one another, projecting a play ring on its longitudinal axis across said playing surface towards one pair of said target post pairs opposite said remaining target post pair, calculating a score based on at least where one of said playing rings comes to rest in respect to said spaced target post pairs defined as closest to said post pairs, between said post pairs, and said playing ring vertically standing closest said target post pairs.

* * * * *